US011780053B2

(12) United States Patent
Koyama

(10) Patent No.: US 11,780,053 B2
(45) Date of Patent: Oct. 10, 2023

(54) SHOT PROCESSING APPARATUS AND SHOT PROCESSING METHOD

(71) Applicant: SINTOKOGIO, LTD., Nagoya (JP)

(72) Inventor: Takuya Koyama, Toyokoawa (JP)

(73) Assignee: SINTOKOGIO, LTD., Nagoya (JP)

( * ) Notice: Subject to any disclaimer, the term of this patent is extended or adjusted under 35 U.S.C. 154(b) by 533 days.

(21) Appl. No.: 16/993,543

(22) Filed: Aug. 14, 2020

(65) Prior Publication Data

US 2021/0060730 A1 Mar. 4, 2021

(30) Foreign Application Priority Data

Aug. 30, 2019 (JP) ..... 2019-158178

(51) Int. Cl.
*B24C 3/20* (2006.01)
*B24C 1/08* (2006.01)

(52) U.S. Cl.
CPC . *B24C 3/20* (2013.01); *B24C 1/08* (2013.01)

(58) Field of Classification Search
CPC ..... B24C 3/20; B24C 1/08; B24C 9/00
USPC ..... 451/38, 36, 75, 76
See application file for complete search history.

(56) References Cited

U.S. PATENT DOCUMENTS

| | | | | |
|---|---|---|---|---|
| 10,022,839 | B2 * | 7/2018 | Kobayashi | C21D 7/06 |
| 2013/0213104 | A1 * | 8/2013 | Yamamoto | C21D 7/06 72/53 |
| 2017/0129073 | A1 | 5/2017 | Wern | |
| 2017/0209982 | A1 * | 7/2017 | Sugiura | B24C 3/24 |
| 2021/0129290 | A1 * | 5/2021 | Ito | B24C 1/10 |

FOREIGN PATENT DOCUMENTS

| | | | |
|---|---|---|---|
| JP | S63-245348 | A | 10/1988 |
| JP | H11-170101 | A | 6/1999 |
| JP | 5877505 | B2 | 3/2016 |
| WO | WO-2013/099411 | A1 | 7/2013 |
| WO | WO-2013/175660 | A1 | 11/2013 |
| WO | WO-2014/192335 | A1 | 12/2014 |
| WO | WO-2019/003647 | A1 | 1/2019 |

* cited by examiner

*Primary Examiner* — Joel D Crandall
*Assistant Examiner* — Shantese L McDonald
(74) *Attorney, Agent, or Firm* — Faegre Drinker Biddle & Reath LLP

(57) ABSTRACT

A shot processing apparatus including: a cabinet with a processing chamber formed therein, the processing chamber allowing a workpiece to be conveyed thereinto; a ejecting mechanism ejecting a shot media to a hole of the workpiece; and a conveyance device conveying the workpiece between a preparation position for the workpiece and the cabinet, wherein the conveyance device includes a plate-like rotary table provided to be rotatable about a rotation axis, being provided with a conveyor for moving the workpiece on an upper surface of the rotary table, and allowing the plurality of workpieces to be arranged thereon, the rotary table connects the conveyor to the preparation position and the cabinet at a predetermined rotational position, and the shot processing apparatus has an inspection area for inspecting a state of the hole of the workpiece, between the preparation position and the rotation axis of the rotary table.

16 Claims, 8 Drawing Sheets

10
41
W1

10
41
W1

10
W1
41
W2

10
W1
41
W2

10
W1
41
W2

10
W2
41
W1

10
W2
41
W3

SHOT PROCESSING APPARATUS AND SHOT PROCESSING METHOD

CROSS-REFERENCE TO RELATED APPLICATIONS

This application is based on and claims the benefit of priority from Japanese Patent Application No. 2019-158178 filed on Aug. 30, 2019, and the entire contents of which are incorporated herein by reference.

TECHNICAL FIELD

This disclosure relates to a shot processing apparatus and a shot processing method.

BACKGROUND

WO2013/175660 discloses an apparatus that shot-peens the inner wall of a hole formed in a workpiece to apply a compressive residual stress.

SUMMARY

Incidentally, it is considered to use an apparatus or the like described in WO2013/175660 to process a workpiece with a hole being formed. It is considered that to secure the quality of the workpiece, the positive or negative quality of the workpiece is inspected. For example, it is considered that after a workpiece processing step, an inspection step is performed, and after the inspection step, a next workpiece processing step is started. However, since the viewable direction of the inner wall of the hole formed in the workpiece is limited, there is a possibility that the inspection step requires time. As more time is required for the inspection step, the start of the next workpiece processing step is delayed. Accordingly, as a result, there is a possibility that the entire processing time for a plurality of workpieces increases.

This disclosure provides a shot processing apparatus and a shot processing method that can reduce the entire processing time for a plurality of workpieces.

An apparatus according to an aspect of this disclosure is a shot processing apparatus that processes a workpiece with a hole being formed therein. This apparatus comprises a cabinet, a ejecting mechanism, and a conveyance device. In the cabinet, a processing chamber is formed therein, the processing chamber allowing the workpiece to be conveyed thereinto. The ejecting mechanism ejects a shot media to a hole of the workpiece arranged in the processing chamber. The conveyance device conveys the workpiece between a preparation position for the workpiece and the cabinet. The conveyance device includes a plate-like rotary table. The rotary table is provided to be rotatable about a rotation axis, a conveyor moving the workpiece is provided on an upper surface of the rotary table, and the rotary table allows a plurality of the workpieces to be arranged thereon. The rotary table connects the conveyor to the preparation position and the cabinet at a predetermined rotational position. This apparatus includes an inspection area for inspecting the state of a hole of the workpiece between the preparation position and the rotation axis of the rotary table.

According to the shot processing apparatus of an aspect of this disclosure, the unprocessed workpiece is conveyed by the conveyance device from the preparation position to the cabinet. The conveyor provided on the rotary table is connected to the preparation position and the cabinet, according to the rotation of the rotary table. When the rotary table is positioned at the predetermined rotational position, the unprocessed workpiece can be moved from the preparation position to the rotary table, and the processed workpiece can be moved from the cabinet to the rotary table. When the rotary table is positioned at the predetermined rotational position, the unprocessed workpiece can be moved from the conveyor to the cabinet, and the processed workpiece can be positioned in the inspection area between the preparation position and the rotation axis of the rotary table. Accordingly, the shot processing apparatus can lap a workpiece processing step and a processed workpiece inspection step. Consequently, the shot processing apparatus can reduce the entire processing time for a plurality of workpieces in comparison with a shot processing apparatus that adopts a linear conveyance path.

In an embodiment, the hole may be formed at a bottom of the workpiece, the inspection area may be set below the rotary table, and a first opening allowing the bottom of the workpiece to be viewed from below may be formed in the rotary table. In this case, the state of the hole formed at the bottom of the workpiece is inspected in the inspection area provided below the rotary table, through the first opening. Consequently, the shot processing apparatus can allow inspection of the state of the hole formed at the bottom of the workpiece without changing the orientation or the like of the workpiece.

In an embodiment, the conveyor may include a first conveyor, and a second conveyor, the first conveyor and the second conveyor may be arranged in such a way as to extend in a same direction as each other, and the first opening may be provided between the first conveyor and the second conveyor. In this case, the shot processing apparatus can convey the workpiece beyond the first opening. Accordingly, the shot processing apparatus can allow inspection of the state of the hole formed at the bottom of the workpiece through the first opening without changing the orientation or the like of the workpiece.

In an embodiment, the conveyor may include a third conveyor, and a fourth conveyor, the third conveyor and the fourth conveyor may be arranged in such a way as to extend in a same direction as each other, and a second opening allowing the bottom of the workpiece to be viewed from below may be formed in the rotary table between the third conveyor and the fourth conveyor. In this case, the shot processing apparatus can convey the workpiece beyond the second opening. Accordingly, the shot processing apparatus can allow inspection of the state of the hole formed at the bottom of the workpiece through the second opening without changing the orientation or the like of the workpiece.

In an embodiment, the cabinet, the rotation axis, and the preparation position may be linearly arranged, the first conveyor, the second conveyor, the third conveyor, and the fourth conveyor may extend in a same direction, and the first conveyor and the second conveyor, and the third conveyor and the fourth conveyor may be arranged line-symmetrically with respect to a line in a radial direction crossing the rotation axis, the line serving as an axis of symmetry. In this case, when the first conveyor and the second conveyor are connected to the preparation position, the third conveyor and the fourth conveyor are connected to the cabinet. When the rotary table is rotated by 180 degrees, the first conveyor and the second conveyor are connected to the cabinet, and the third conveyor and the fourth conveyor are connected to the preparation position. In this manner, the conveyor can be connected to both the cabinet and the preparation position at every 180-degree rotation. Accordingly, movement of the workpiece between the rotary table and the preparation position, and movement of the workpiece between the rotary table and the cabinet, can be performed at every 180-degree rotation. Accordingly, the operation efficiency is further improved, and thus, the shot processing apparatus can further reduce the entire processing time for a plurality of workpieces.

In an embodiment, the rotary table may be supported at a predetermined height corresponding to the preparation position, and the shot processing apparatus may further comprise a lifting and lowering unit lifting and lowering the workpiece to the preparation position. In this case, the shot processing apparatus can automate the arrangement of the workpiece to the preparation position.

In an embodiment, the shot processing apparatus may apply a peening process to the inner wall of the hole. In this case, the shot processing apparatus can apply the compressive residual stress to the inner wall of the hole.

In an embodiment, the ejecting mechanism may comprise: a pressure tank retaining the shot media and being connected to a compressed gas supply source; a mixing unit connected to the compressed gas supply source and mixing the shot media supplied at a constant rate from the pressure tank with compressed air; and a nozzle connected to the mixing unit and ejecting the shot media together with the compressed air. In this case, the shot processing apparatus can eject the shot media together with the compressed air.

A method according to another aspect of this disclosure is a shot processing method that processes a workpiece with a hole being formed therein. This method comprises: a step of arranging a first workpiece at a preparation position; a step of rotating a plate-like rotary table provided to be rotatable about a rotation axis and being provided, on an upper surface of the table, with a conveyor having a first end and a second end, thereby connecting the preparation position and the first end of the conveyor to each other; a step of moving the first workpiece from the preparation position to the conveyor of the rotary table; a step of rotating the rotary table with the first workpiece being arranged thereon, of connecting a cabinet including a processing chamber to the first end of the conveyor, and of connecting the preparation position to the second end of the conveyor; a step of moving the first workpiece from the rotary table to the processing chamber; a step of arranging a second workpiece at a preparation position; a step of moving the second workpiece from the preparation position to the rotary table; a step of moving the processed first workpiece to the rotary table; a step of rotating the rotary table with the first workpiece and the second workpiece being arranged thereon, of connecting the cabinet to the second end of the conveyor, and of connecting the preparation position to the first end of the conveyor; and a step of moving the second workpiece from the rotary table to the processing chamber, and of inspecting the processed first workpiece on the rotary table.

According to the shot processing method of the other aspect this disclosure, the first workpiece is arranged on the rotary table, and is conveyed to the position facing the cabinet by rotation of the rotary table. The first workpiece is conveyed into the cabinet and is processed. The second workpiece is then arranged on the rotary table. The processed first workpiece is rearranged on the rotary table. By rotation of the rotary table on which the processed first workpiece and the second workpiece are arranged, the processed first workpiece is arranged in the inspection area, and the second workpiece is conveyed to the position facing the cabinet. As described above, when the first workpiece is arranged in the inspection area, the shot processing method can bring the second workpiece into a state of being conveyable into the cabinet. Consequently, the shot processing method can lap a workpiece processing step and a processed workpiece inspection step. Consequently, the shot processing method can reduce the entire processing time for a plurality of workpieces in comparison with a shot processing method that adopts a linear conveyance path.

According to this disclosure, the entire processing time for a plurality of workpieces can be reduced.

DETAILED DESCRIPTION

Figure 1:
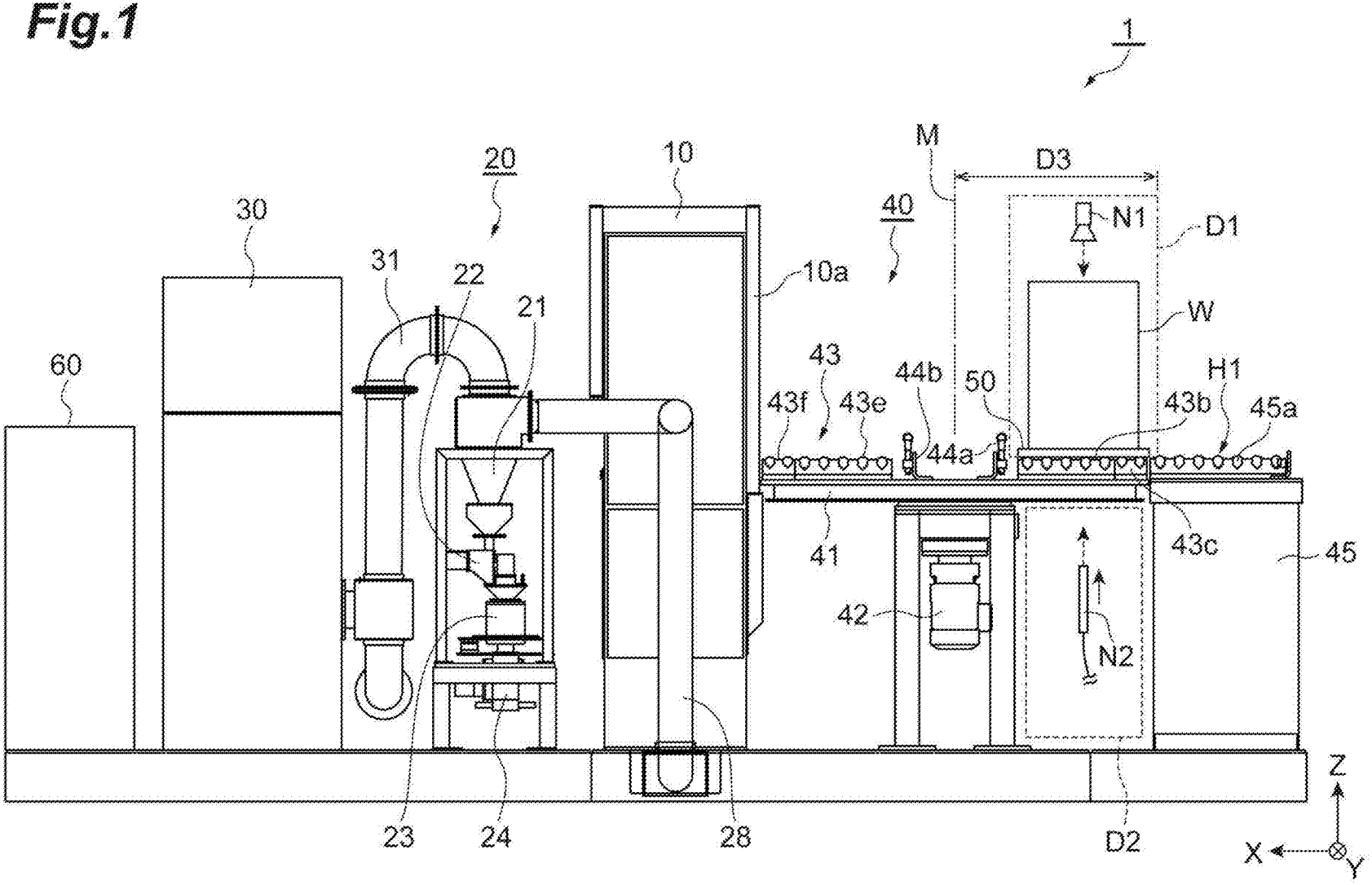
FIG. 1 is a front view showing an example of a shot processing apparatus according to an embodiment.

Hereinafter, referring to the drawings, an embodiment is described. Note that in the following description, the same or equivalent elements are assigned with the same symbols, and redundant description is omitted. The direction of "vertical direction" in this specification is indicated in the drawings unless otherwise specified, while description is also made with the X direction, Y direction and Z direction in the drawings. Here, in visual lines of FIG. 1, the X direction, Y direction and Z direction indicate the horizontal directions (X direction and Y direction) and vertical direction (Z direction) with respect to the plane of the sheet.

Configuration of Workpiece

Figure 4:
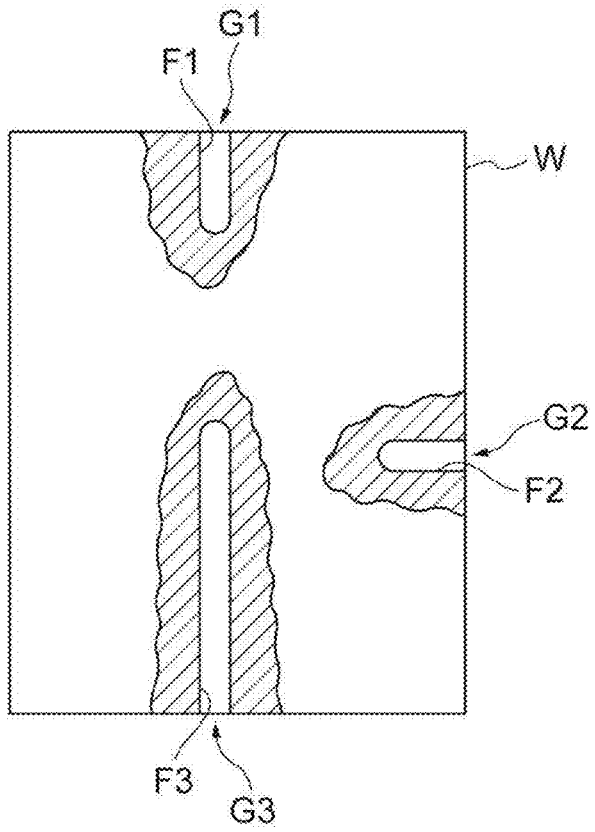
FIG. 4 is a partial sectional view showing an example of a workpiece.

FIG. 4 is a partial sectional view showing an example of a workpiece. As shown in FIG. 4, a workpiece W is a three-dimensional object, and holes are formed toward the inside. In the example of FIG. 4, three holes G1 to G3 are formed on the external surfaces of the workpiece W. The number of holes is not limited to three, and may be one or two or more. The workpiece is made of a metal. An example of the workpiece is a cylinder head, a cylinder block or a crankshaft of an engine, or a die. An example of a hole is a cooling hole, such as a water-cooling hole, a hole for an extrusion pin, or an insertion hole for a deep thermometer. The inner diameter of a hole is, for example, about 4 to 15 mm, and the length (depth) of the hole is, for example, about 50 to 400 mm. In this embodiment, a shot process is applied to a water-cooling hole provided in a casting die.

Examples of the shot process include a blast process that grinds a surface, and a shot peening process that applies a compressive residual stress. The processing is not limited to the specific examples described above, but can include any appropriate process applicable to the side wall of a hole. In this embodiment, a shot peening process is performed as a shot process.

Configuration of Shot Processing Apparatus

Figure 2:
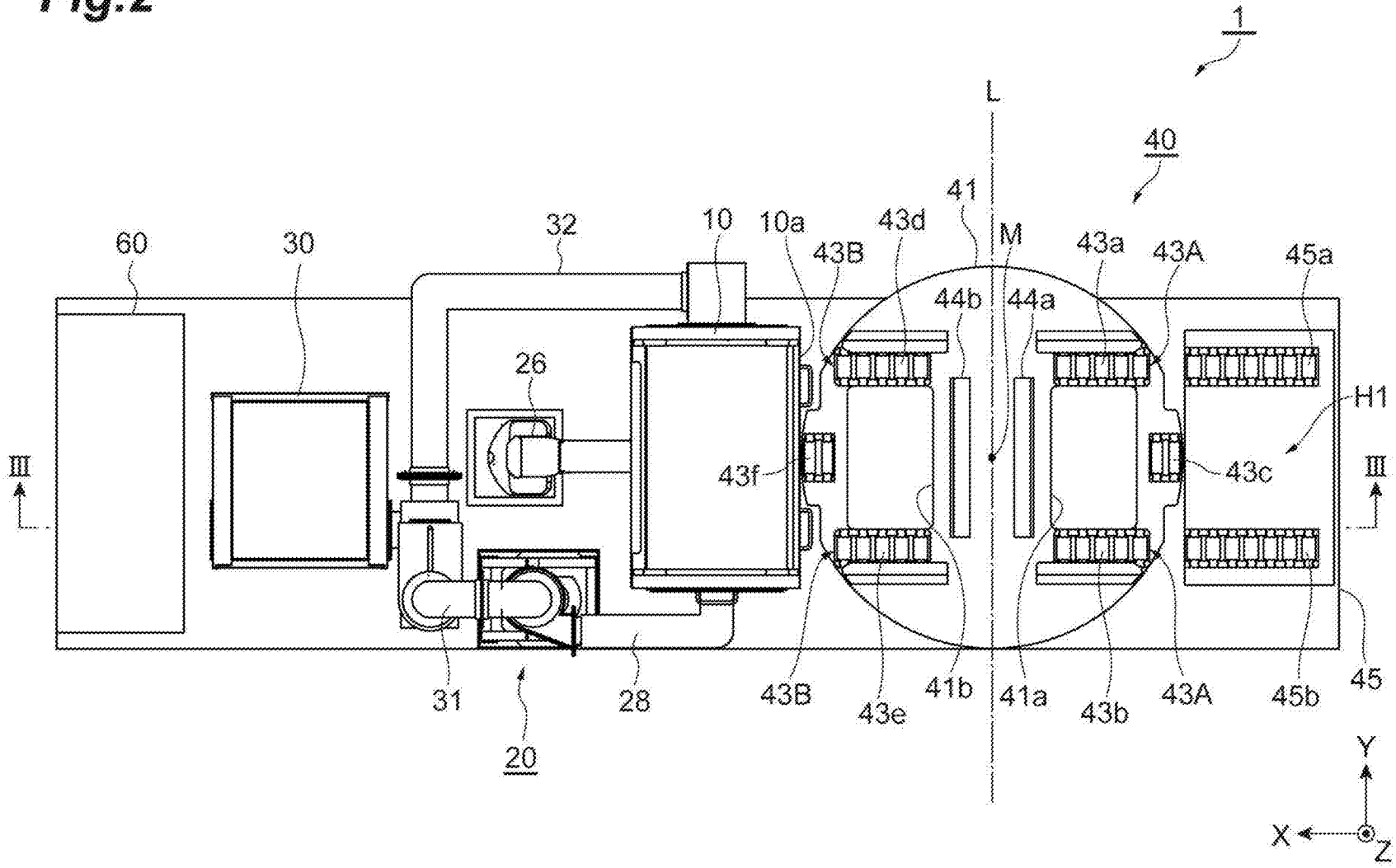
FIG. 2 is a plan view of the shot processing apparatus shown in FIG. 1.
Figure 3:
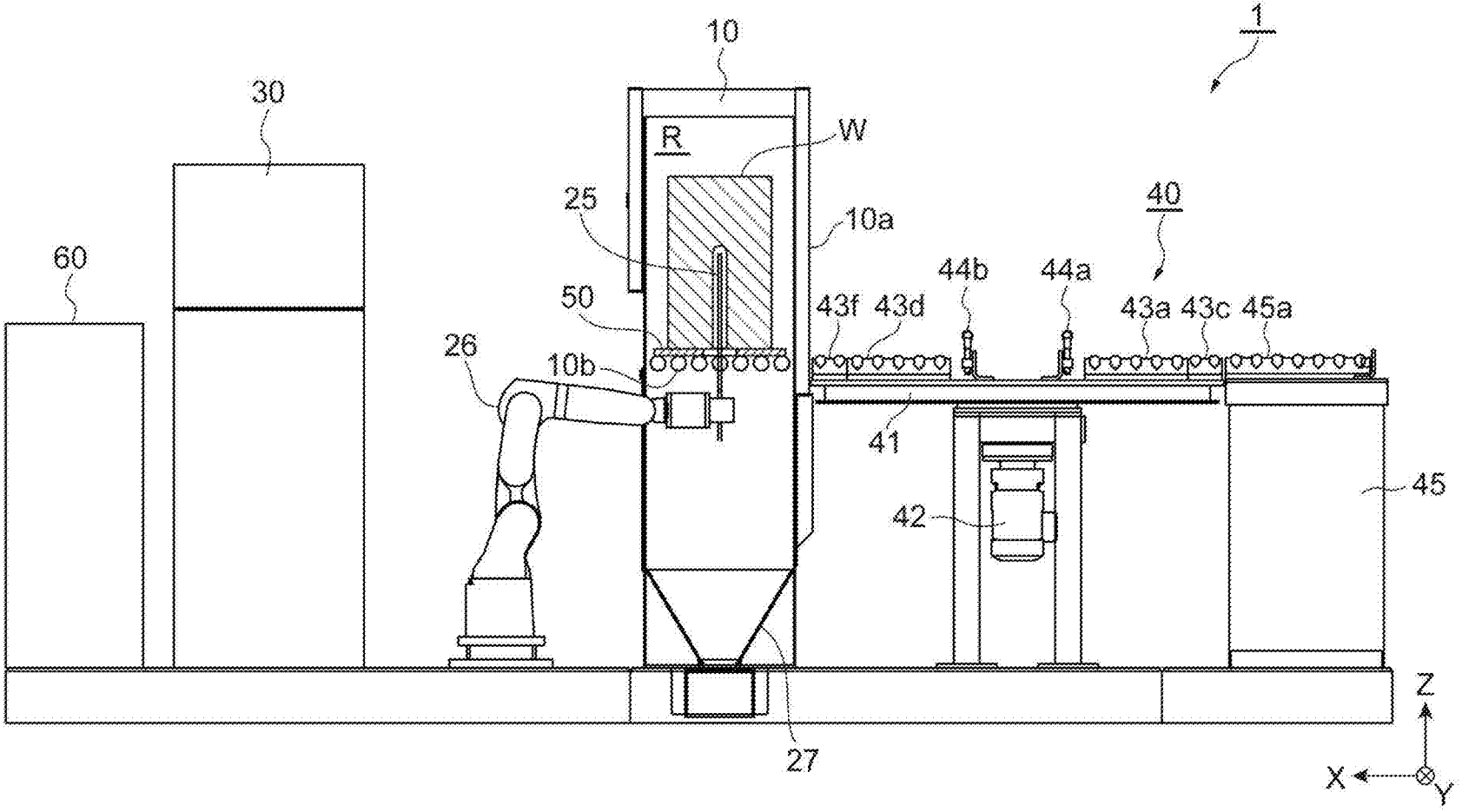
FIG. 3 is a partial sectional view taken along line III-III of FIG. 2.

FIG. 1 is a front view showing an example of a shot processing apparatus according to an embodiment. FIG. 2 is a plan view of the shot processing apparatus shown in FIG. 1. FIG. 3 is a partial sectional view taken along line III-III of FIG. 2. The shot processing apparatus 1 shown in FIGS. 1 to 3 is an apparatus that processes a workpiece with a hole being formed.

The shot processing apparatus 1 comprises a cabinet 10, a ejecting mechanism 20, a dust collector 30, a conveyance device 40, and a controller 60.

In the cabinet 10, a processing chamber R (see FIG. 3) into which the workpiece W is to be conveyed, is formed. The cabinet 10 is, for example, a box. On a side surface of the cabinet 10, a shutter 10*a* that opens and closes the cabinet 10 is provided. For example, the shutter 10*a* opens and closes an upper half of the side surface of the cabinet 10. When the workpiece W is conveyed into the processing chamber R or when the workpiece W is conveyed out of the processing chamber R, the shutter 10*a* is opened to open the cabinet 10. The shutter 10*a* is closed when the workpiece W is processed, and seals the cabinet 10. Driving of the shutter 10*a* is achieved by a drive device, not shown. In the processing chamber R, a stage 10*b* (see FIG. 3) that movably supports the workpiece W is supported at a predetermined height position. The stage 10*b* is, for example, a roller conveyor.

The ejecting mechanism 20 ejects a shot media to a hole of the workpiece W arranged in the processing chamber R. An example of the shot media is abrasive grains, such as shot (steel balls). Any type of device, such as a gravity type (suction type) device, a direct pressure type (pressure type) device, or a centrifugal type device, may be used as the ejecting mechanism 20. The shot processing apparatus according to this embodiment uses a direct pressure type ejecting mechanism, for example.

The ejecting mechanism 20 comprises a pressure tank 23, a mixing unit 24, and a nozzle 25. The pressure tank 23 retains the shot media, and is connected to a compressed gas supply source (not shown). The inside of the pressure tank 23 is pressurized with compressed air supplied from the compressed gas supply source. The mixing unit 24 is disposed below the pressure tank 23, for example. The mixing unit 24 is connected to the compressed gas supply source (not shown), and mixes the shot media supplied from the pressure tank 23 at a constant rate with compressed air. The nozzle 25 is disposed in the processing chamber R. The nozzle 25 is connected to the mixing unit 24, and ejects the shot media together with the compressed air. The position and ejecting direction of the nozzle 25 are controlled by a robot 26 (see FIGS. 2 and 3). The nozzle 25 is gripped by the robot 26 and is inserted into the hole of the workpiece W.

The ejecting mechanism 20 may comprise a mechanism that reuses the shot media having used for processing. A hopper 27 is disposed at a lower part of the processing chamber R. The shot media ejected through the nozzle 25 falls downward with powder dust, in the processing chamber R, and is stored in the hopper 27. The hopper 27 is connected with a duct 28. The duct 28 is connected to a cyclone 21 that performs sorting using air. The powder dust and shot media stored in the hopper 27 are supplied to the cyclone 21 through the duct 28, and are sorted into the powder dust and the usable shot media. The cyclone 21 is connected to the pressure tank 23. The usable shot media is supplied to the pressure tank 23, and is reused as a shot media to be ejected to the workpiece W.

The cyclone 21 is connected to the dust collector 30 through a duct 31. The dust collector 30 is a device that suctions and removes the powder dust. The powder dust sorted by the cyclone 21 is suctioned by the dust collector 30 through the duct 31. The processing chamber R is connected to the dust collector 30 through a duct 32. The powder dust in the processing chamber R is suctioned by the dust collector 30 through the duct 32.

The conveyance device 40 conveys the workpiece W between a preparation position H1 of the workpiece W and the cabinet 10. The preparation position H1 is a position where a workpiece W to be processed next is arranged, and is at the same height as that of the stage 10*b* accommodated in the processing chamber R. The preparation position H1 may be a position to which a processed workpiece W is returned. The conveyance device 40 includes a plate-like rotary table 41 on which a plurality of workpieces W can be arranged. The rotary table 41 may have, for example, a disk shape. The rotary table 41 is provided to be rotatable about a rotation axis M (see FIG. 1) extending in the Z direction. The rotary table 41 is rotated by a rotary motor 42. The rotary table 41 is arranged between the preparation position H1 and the cabinet 10. For example, the rotary table 41 is arranged such that the rotation axis M, the cabinet 10 and the preparation position H1 are linearly arranged. The rotary table 41 is supported at a predetermined height corresponding to the preparation position H1. For example, the rotary table 41 is supported to have the same height as the preparation position H1.

The rotary table 41 is provided with a conveyor 43 (see FIG. 1) that moves the workpiece W, on the upper surface of this table. The rotary table 41 connects the conveyor 43 to the preparation position H1 and the cabinet 10 at a predetermined rotational position. When a first end 43A (see FIG. 2) of the conveyor 43 is connected to the preparation position H1, a second end 43B (see FIG. 2) of the conveyor 43 is connected to the cabinet 10. This allows movement of the workpiece W between the rotary table 41 and the preparation position H1, and movement of the workpiece W between the rotary table 41 and the cabinet 10, to be performed in parallel. Note that in the example of FIG. 2, the rotation axis M, the cabinet 10 and the preparation position H1 are linearly arranged. Accordingly, when the first end 43A of the conveyor 43 is connected to the cabinet 10, the second end 43B of the conveyor 43 is connected to the preparation position H1. As described above, only with a half turn, the rotary table 41 can reconnect the conveyor 43 to the preparation position H1 and the cabinet 10. That is, in this embodiment, a predetermined rotational position is a multiple of 180 degrees. An example of a conveyor 43 is a roller conveyor.

The rotary table 41 arranges a plurality of workpieces W (two workpieces W in this embodiment) at the predetermined rotational position. Accordingly, the conveyor 43 can be separated into those for the workpieces W. For example, the conveyor 43 is separated into two with reference to a line L (see FIG. 2) in a radial direction crossing the rotation axis M.

The conveyor 43 includes a first conveyor 43*a* and a second conveyor 43*b*, for a first workpiece. The first conveyor 43*a* and the second conveyor 43*b* are arranged in such a way as to extend in the same direction with respect to each other. The first conveyor 43*a* and the second conveyor 43*b* are provided apart in parallel. A first opening 41*a* allowing the bottom of the workpiece W to be viewed from below is formed in the rotary table 41 between the first conveyor 43*a* and the second conveyor 43*b*. The first opening 41*a* is formed through the rotary table 41, and functions as a window during an inspection, as described later. The conveyor 43 may comprise a first auxiliary conveyor 43*c* on the rotary table 41 outer in the radial direction than the first opening 41*a*. The first auxiliary conveyor 43*c* supports the movement of the workpiece W.

The conveyor 43 includes a third conveyor 43*d* and a fourth conveyor 43*e*, for a second workpiece. The third conveyor 43*d* and the fourth conveyor 43*e* are arranged in such a way as to extend in the same direction with respect to each other. The third conveyor 43*d* and the fourth conveyor 43*e* are provided apart in parallel. A second opening 41*b* allowing the bottom of the workpiece W to be viewed from below is formed in the rotary table 41 between the third conveyor 43*d* and the fourth conveyor 43*e*. The second opening 41*b* is formed through the rotary table 41, and functions as a window during an inspection, as described later. The conveyor 43 may comprise a second auxiliary conveyor 43*f* on the rotary table 41 outer in the radial direction than the second opening 41*b*. The second auxiliary conveyor 43*f* supports the movement of the workpiece W.

The first conveyor 43*a*, the second conveyor 43*b*, the third conveyor 43*d*, and the fourth conveyor 43*e* may extend in the same direction. The first conveyor 43*a*, the second conveyor 43*b*, the third conveyor 43*d*, and the fourth conveyor 43*e* may be arranged line-symmetrically with respect to the line L that is in the radial direction, passes through the rotation axis M, and serves as the axis of symmetry. Accordingly, at every 180-degree rotation of the rotary table 41, the conveyor 43 can be connected to the preparation position H1 and the cabinet 10.

The rotary table 41 may be provided with a first stopper 44*a* corresponding to the first conveyor 43*a* and the second conveyor 43*b* at the center of this table. The rotary table 41 may be provided with a second stopper 44*b* corresponding to the third conveyor 43*d* and the fourth conveyor 43*e* at the center of this table. Accordingly, the workpiece W can stop on the rotary table 41. The first stopper 44*a* and the second stopper 44*b* may be provided with pins for fixing the workpiece W.

The shot processing apparatus 1 includes an inspection area for inspecting the state of holes of the workpiece W between the preparation position H1 and the rotation axis M of the rotary table 41 (an area D3 in FIG. 1). The inspection area is a place where an operator, a robot or the like performs visual contact or uses an inspection instrument, and is set above or below the rotary table 41. A first inspection area D1 is set to be above the rotary table 41, and inspects the state of a hole formed on the upper surface or a side surface of the workpiece W using a first inspection instrument N1. A second inspection area D2 is set to be below the rotary table 41, and inspects the state of a hole formed at the bottom of the workpiece W using a second inspection instrument N2. The first inspection instrument N1 and the second inspection instrument N2 are devices that include a sensor function. Appropriate instruments are prepared in conformity with checking of the residual stress, color, roughness, residual sand and the like.

The shot processing apparatus 1 comprises a lifting and lowering unit 45 that lifts and lowers the workpiece W to the preparation position H1. The lifting and lowering unit 45 includes a fifth conveyor 45*a* that can arrange the workpiece W. The lifting and lowering unit 45 moves the fifth conveyor 45*a* to the preparation position H1 by a drive source, not shown. Accordingly, preparation of the workpiece W can be automatically performed.

The components of the shot processing apparatus 1 described above are integrated by the controller 60. The controller 60 includes, for example, a display unit and a processing unit, for example. The processing unit is a typical computer that includes a CPU and a storage. The controller 60 executes conveyance, processing, inspection and the like of the workpiece W, using a preset program.

Tray for Conveyance

Figure 5A:
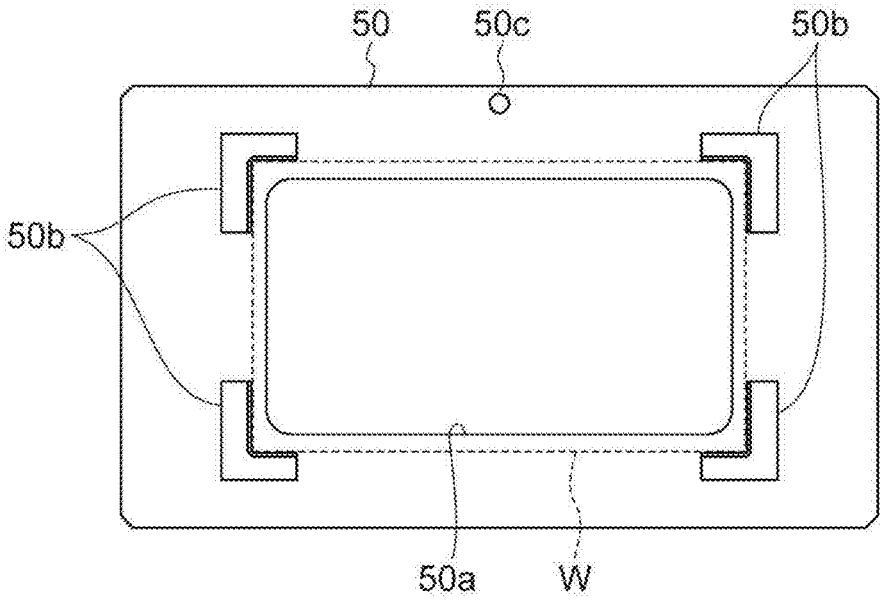
FIGS. 5A and 5B show an example of a tray.
Figure 5B:
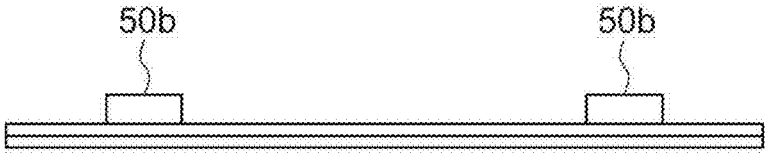
Figure 6A:
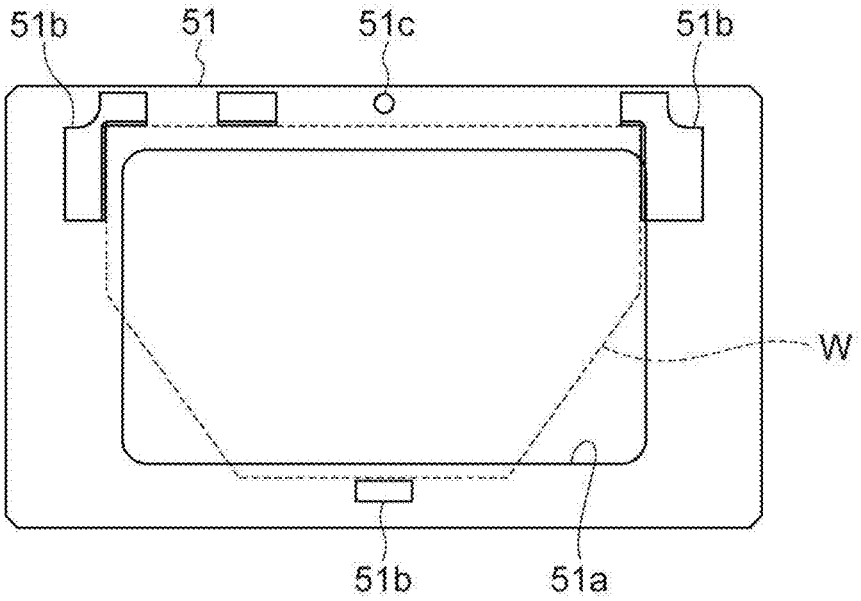
FIGS. 6A and 6B show another example of a tray.
Figure 6B:
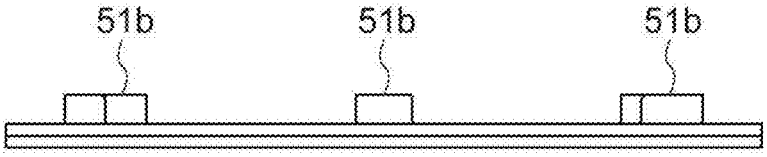

The workpiece W may be arranged on a tray 50 and be conveyed. The rotary table 41 has the openings. Accordingly, there is a possibility that conveyance cannot be performed with a certain width of the workpiece W. By using the tray 50, workpieces W having various widths can be supported. In this case, to inspect the hole formed at the bottom of the workpiece W, an opening is also formed in the tray 50. FIGS. 5A and 5B show an example of the tray. FIG. 5A is a plan view. FIG. 5B is a side view. The tray 50 shown in FIGS. 5A and 5B includes fixation parts 50*b* that position the workpiece W, and an opening 50*a* formed in an area encircled by the fixation parts 50*b*. In the tray 50, a hole 50*c* to be engaged with the pin provided for the first stopper 44*a* or the second stopper 44*b* of the rotary table, is formed. By engagement between the pin and the hole 50*c*, falling of the workpiece due to the centrifugal force of the rotary table 41 can be prevented. Note that the size of the opening 50*a* and the position of the fixation part 50*b* can be appropriately changed in conformity with the workpiece W. FIGS. 6A and 6B show another example of the tray. FIG. 6A is a plan view. FIG. 6B is a side view. The tray 51 shown in FIGS. 6A and 6B has an opening 51*a* slightly larger than the opening 50*a*, and a fixation part 51*b* arranged in conformity with the shape of the opening 51*a*. Similar to the hole 50*c*, a hole 51*c* is formed in the tray 51.

Shot Processing Method

Figure 7:
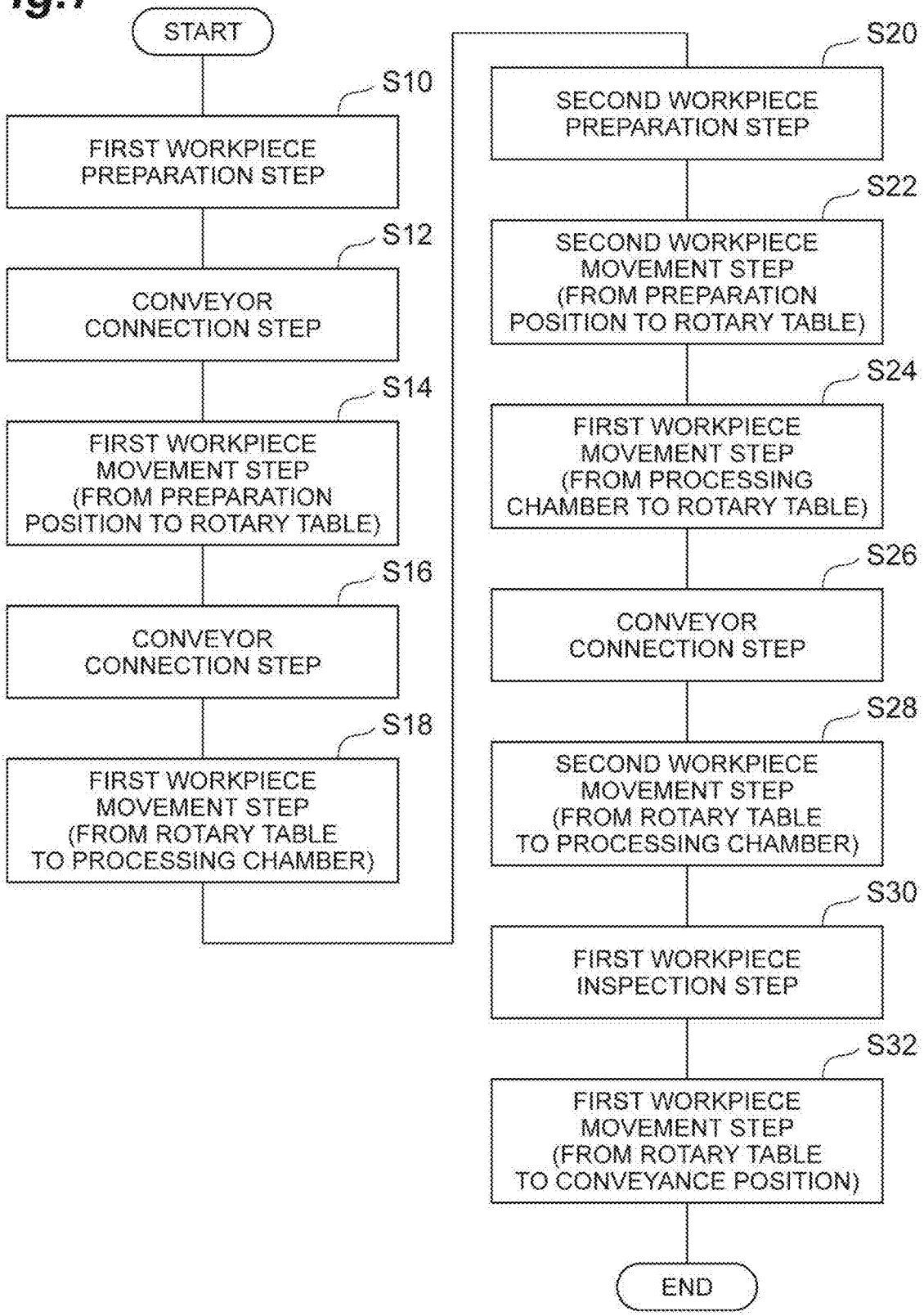
FIG. 7 is a flowchart showing an example of a shot processing method according to an embodiment.

FIG. 7 is a flowchart showing an example of a shot processing method according to an embodiment. The flowchart shown in FIG. 7 shows processes from preparation of a first workpiece W1 to completion of inspection, and processes of a second workpiece W2 that is to be processed next to the first workpiece W1. Hereinafter, an example of the controller 60 executing the flowchart is described. However, some or all of the processes may be manually performed. Note that the flowchart is described with reference to FIGS. 8A to 8G. FIGS. 8A to 8G show an example of workpiece movement by the shot processing method according to the embodiment.

First, as a first work preparation step (S10), the controller 60 prepares the first workpiece W1 to the preparation position H1. For example, the controller 60 causes another conveyor to arrange the first workpiece W1 on the fifth conveyor 45*a* of the lifting and lowering unit 45. The controller 60 causes the lifting and lowering unit 45 to lift the fifth conveyor 45*a* to be at the height of the preparation position H1.

Subsequently, as a conveyor connection step (S12), the controller 60 connects the preparation position H1 and the first end 43A of the conveyor 43 to each other. The controller 60 rotates the rotary table 41 to a predetermined rotational position, thereby connecting the conveyor 43 of the rotary table 41 to the fifth conveyor 45*a* at the preparation position H1. Note that if the rotary table 41 has already been positioned at the predetermined rotational position, the conveyor connection step (S12) can be omitted.

Subsequently, as a first workpiece movement step (S14), the controller 60 moves the first workpiece W1 from the preparation position H1 to the conveyor 43 of the rotary table 41. The controller 60 drives the fifth conveyor 45*a*, and the first conveyor 43*a* and the second conveyor 43*b*, thereby moving the first workpiece W1 from the preparation position H1 to the conveyor 43 of the rotary table 41. The first workpiece W1 is positioned by coming into contact with the first stopper 44*a*. When the tray 50 is used, the hole 50*c* and the pin of the first stopper 44*a* are engaged with and fixed to each other.

Figures 8A, 8B, 8C, 8D, 8E, 8F, 8G:
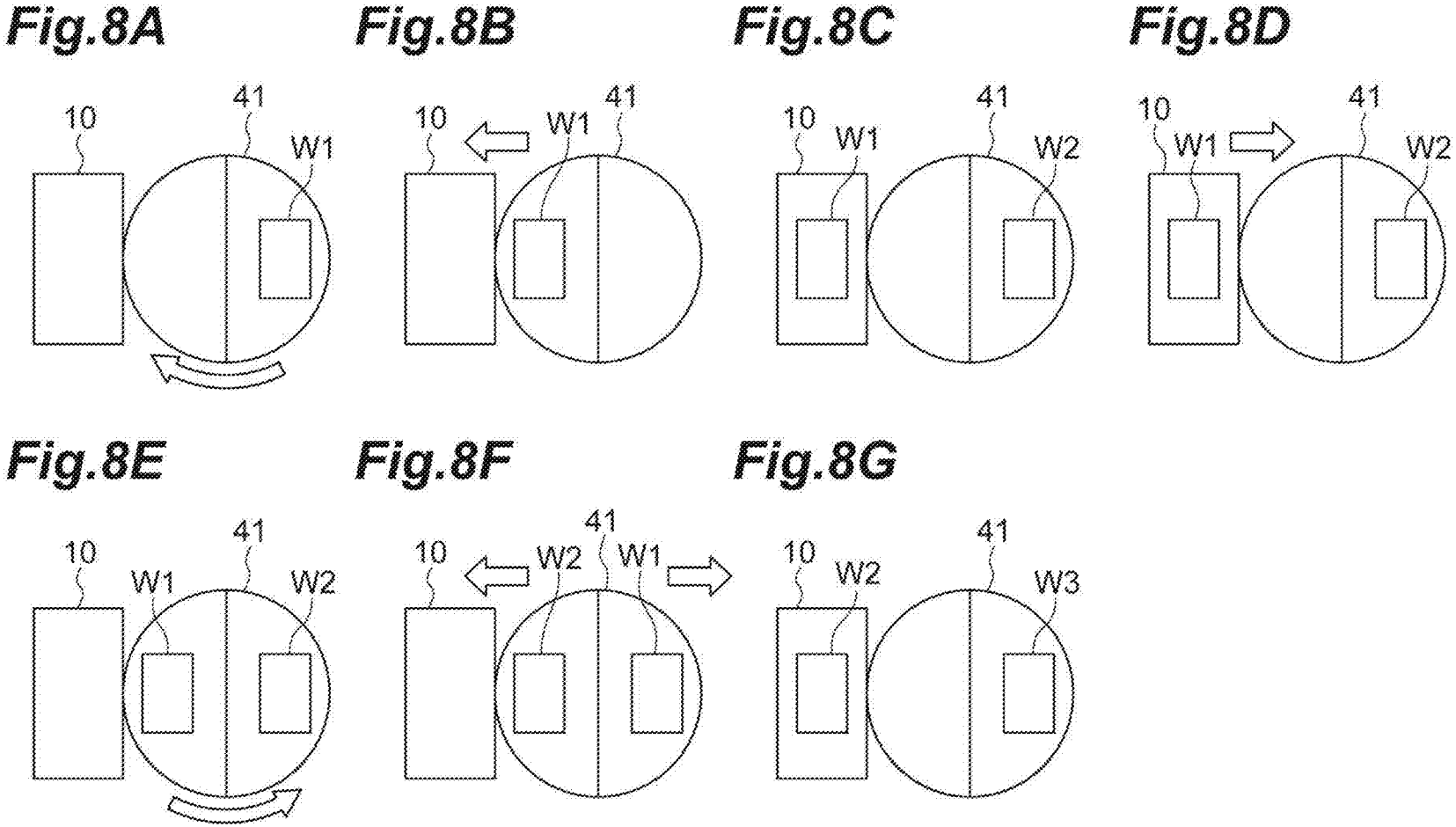
FIGS. 8A to 8G show an example of workpiece movement by the shot processing method according to an embodiment.

Subsequently, as a conveyor connection step (S16), the controller 60 rotates the rotary table 41 to connect the cabinet 10 to the first end 43A of the conveyor 43 and to connect the preparation position H1 to the second end 43B of the conveyor 43. The controller 60 rotates the rotary table 41 to move the first workpiece W1 to a position facing the cabinet 10. For example, as shown in FIGS. 8A and 8B, by a 180-degree rotation of the rotary table 41, the first workpiece W1 moves to the position facing the cabinet 10. At this time, the stage 10*b* in the cabinet 10 is connected to the first conveyor 43*a* and the second conveyor 43*b* of the conveyor 43. Furthermore, the fifth conveyor 45*a* at the preparation position H1 is connected to the third conveyor 43*d* and the fourth conveyor 43*e* of the conveyor 43.

Subsequently, as a first workpiece movement step (S18), the controller 60 moves the first workpiece W1 from the rotary table 41 to the processing chamber R. The controller 60 drives the first conveyor 43*a* and the second conveyor 43*b*, and the stage 10*b*, thereby moving the first workpiece W1 from the rotary table 41 to the processing chamber R. The controller 60 processes the holes formed in the first workpiece W1 in the processing chamber R.

A second workpiece preparation step (S20) and a second workpiece movement step (S22) can start at the same time of the first workpiece movement step (S18), and is finished before start of a conveyor connection step (S24) described later. Hereinafter, for the sake of description, description is made in the order of the first workpiece movement step (S18), the second workpiece preparation step (S20), the second workpiece movement step (S22), and the first workpiece movement step (S24). However, the execution order is not limited thereto.

As the second workpiece preparation step (S20), the controller 60 prepares the second workpiece W2 to the preparation position H1. For example, the controller 60 causes another conveyor to arrange the second workpiece W2 on the fifth conveyor 45*a* of the lifting and lowering unit 45. The controller 60 causes the lifting and lowering unit 45 to lift the fifth conveyor 45*a* to be at the height of the preparation position H1.

As the second workpiece movement step (S22), the controller 60 moves the second workpiece W2 from the preparation position H1 to the conveyor 43 of the rotary table 41. The controller 60 drives the fifth conveyor 45*a*, and the third conveyor 43*d* and the fourth conveyor 43*e*, thereby moving the second workpiece W2 from the preparation position H1 to the conveyor 43 of the rotary table 41. The second workpiece W2 is positioned by coming into contact with the second stopper 44*b*. When the tray 50 is used, the hole 50*c* and the pin of the second stopper 44*b* are engaged with and fixed to each other. As shown in FIGS. 8B and 8C, the first workpiece W1 is processed in the cabinet 10, and the second workpiece W2 comes into a state of being arranged on the rotary table.

As the first workpiece movement step (S24), the controller 60 moves the first workpiece W1 from the processing chamber R to the conveyor 43 of the rotary table 41. The controller 60 drives the stage 10*b*, and the first conveyor 43*a* and the second conveyor 43*b*, thereby moving the first workpiece W1 from the processing chamber R to the conveyor 43 of the rotary table 41. The first workpiece W1 is positioned by coming into contact with the first stopper 44*a*. As shown in FIGS. 8C and 8D, the first workpiece W1 moves from the cabinet 10 to the rotary table 41.

After the first workpiece movement step (S18), the second workpiece preparation step (S20), the second workpiece movement step (S22), and the first workpiece movement step (S24) are finished, the conveyor connection step (S26) is executed.

As the conveyor connection step (S26), the controller 60 rotates the rotary table 41 to connect the cabinet 10 to the second end 43B of the conveyor 43 and to connect the preparation position H1 to the first end 43A of the conveyor 43. The controller 60 rotates the rotary table 41 to thereby move the first workpiece W1 to a position facing the preparation position H1 and to thereby move the second workpiece W2 to the position facing the cabinet 10. Accordingly, the first workpiece W1 is positioned in the inspection area. For example, as shown in FIGS. 8E and 8F, by a 180-degree rotation of the rotary table 41, the first workpiece W1 moves to the position facing the preparation position H1, and the second workpiece W2 moves to the position facing the cabinet 10. At this time, the stage 10*b* in the cabinet 10 is connected to the third conveyor 43*d* and the fourth conveyor 43*e* of the conveyor 43. Furthermore, the fifth conveyor 45*a* at the preparation position H1 is connected to the first conveyor 43*a* and the second conveyor 43*b* of the conveyor 43.

Subsequently, as the second workpiece movement step (S28), the controller 60 moves the second workpiece W2 from the rotary table 41 to the processing chamber R. The controller 60 drives the third conveyor 43*d* and the fourth conveyor 43*e*, and the stage 10*b*, thereby moving the second workpiece W2 from the rotary table 41 to the processing chamber R. The controller 60 processes the holes formed in the second workpiece W2 in the processing chamber R.

A first workpiece inspection step (S30) can be started at the same time as the second workpiece movement step (S28). As the first workpiece inspection step (S30), the controller 60 causes the first inspection instrument N1 and the second inspection instrument N2 to inspect the first workpiece W1.

Subsequently, as a first workpiece movement step (S32), the controller 60 moves the first workpiece W1 from the conveyor 43 of the rotary table 41 to the preparation position H1. The controller 60 drives the fifth conveyor 45*a*, and the first conveyor 43*a* and the second conveyor 43*b*, thereby moving the first workpiece W1 from the conveyor 43 of the rotary table 41 to the preparation position H1. At this time, the preparation position serves as a workpiece discharge position. The first workpiece W1 is lowered by the lifting and lowering unit 45 and is discharged. After the first workpiece movement step (S32) is finished, the flowchart shown in FIG. 7 is finished. Workpieces W are sequentially processed. Accordingly, as shown in FIGS. 8F and 8G, after the first workpiece W1 is discharged, a third workpiece W3 is arranged. The processes thereafter are repeated similarly from FIG. 8C.

Overall of Embodiment

According to the shot processing apparatus 1 and the shot processing method, the unprocessed workpiece W is conveyed by the conveyance device 40 from the preparation position H1 to the cabinet 10. The conveyor 43 provided on the rotary table 41 is connected to the preparation position H1 and the cabinet 10, according to the rotation of the rotary table 41. When the rotary table 41 is positioned at the predetermined rotational position, the unprocessed workpiece W can be moved from the preparation position H1 to the rotary table 41, and the processed workpiece W can be moved from the cabinet 10 to the rotary table 41. When the rotary table 41 is positioned at the predetermined rotational position, the unprocessed workpiece W can be moved from the conveyor 43 to the cabinet 10, and the processed workpiece W can be positioned in the inspection area (the first inspection area D1, and the second inspection area D2) between the preparation position H1 and the rotation axis M of the rotary table 41. Accordingly, the shot processing apparatus 1 and the shot processing method can lap a workpiece W processing step, and a processed workpiece W inspection step. Consequently, the shot processing apparatus 1 and the shot processing method can reduce the entire processing time for a plurality of workpieces W in comparison with a shot processing apparatus that adopts a linear conveyance path.

According to the shot processing apparatus 1 and the shot processing method, the state of the hole formed at the bottom of the workpiece W is inspected in the second inspection area D2 provided below of the rotary table 41 through the first opening 41*a* or the second opening 41*b*. Consequently, the shot processing apparatus 1 and the shot processing method can allow inspection of the state of the hole formed at the bottom of the workpiece W without changing the orientation or the like of the workpiece W.

According to the shot processing apparatus 1 and the shot processing method, the workpiece can be conveyed beyond the first opening 41*a* and the second opening 41*b*. Consequently, the shot processing apparatus 1 and the shot processing method can allow inspection of the state of the hole formed at the bottom of the workpiece W without changing the orientation or the like of the workpiece W through the first opening 41*a* or the second opening 41*b*.

The conveyor 43 can be connected to both the cabinet 10 and the preparation position H1 at every 180-degree rotation. Accordingly, the shot processing apparatus 1 and the shot processing method can move the workpiece W between the rotary table 41 and the preparation position H1 and move the workpiece W between the rotary table 41 and the cabinet 10, at every 180-degree rotation. Accordingly, the operation efficiency is further improved. Consequently, the shot processing apparatus 1 and the shot processing method can further reduce the entire processing time for a plurality of workpieces W.

This embodiment has thus been described above. However, this disclosure is not limited to this embodiment described above. It is a matter of course that this disclosure can be variously changed in a scope without departing from the spirit thereof and be executed, also in those other than this embodiment.

For example, the conveyor 43 may be a roller conveyer with free rollers, or a conveyor belt. In the case where the roller conveyor with free rollers is adopted as the conveyor 43, the operator may manually convey a workpiece, or the roller conveyor with free rollers may be provided with a pusher or the like to automatize the conveyance of the workpiece. Only the second inspection area D2 may be set as the inspection area. In a case where a plurality of processing chambers R are provided or in a case where a plurality of preparation positions H1 are provided, a conveyor may be provided such that some or all of them can be connected at a predetermined rotational position. The inspection step can be executed when the workpiece W is positioned in the inspection area. Accordingly, this step may be executed for an unprocessed workpiece W, for example.

The first inspection instrument N1 and the second inspection instrument N2 may further inspect residues, such as processing unevenness and burrs.

REFERENCE SIGNS LIST

1 . . . Shot processing apparatus, 10 . . . Cabinet, 20 . . . Ejecting mechanism, 23 . . . Pressure tank, 24 . . . Mixing unit, 25 . . . Nozzle, 40 . . . Conveyance device, 41 . . . Rotary table, 41*a* . . . First opening, 41*b* . . . Second opening, 43 . . . Conveyor, 43A . . . First end, 43*a* . . . First conveyor, 43B . . . Second end, 43*b* . . . Second conveyor, 43*d* . . . Third conveyor, 43*e* . . . Fourth conveyor, 45 . . . Lifting and lowering unit, F1 to F3 . . . Inner walls, H1 . . . Preparation position, G1 to G3 . . . Holes, L . . . Line, M . . . Rotation axis, R . . . Processing chamber, W . . . Workpiece, W1 . . . First workpiece, W2 . . . Second workpiece.

What is claimed is:

1. A shot processing apparatus processing a workpiece with a hole formed therein, comprising:

a cabinet with a processing chamber formed therein, the processing chamber allowing the workpiece to be conveyed thereinto;

an ejecting mechanism configured to eject a shot media to a hole of the workpiece arranged in the processing chamber; and a conveyance device configured to convey the workpiece between a preparation position for the workpiece and the cabinet, wherein the conveyance device includes a plate-like rotary table provided to be rotatable about a rotation axis, being provided with a conveyor for moving the workpiece on an upper surface of the rotary table, and allowing a plurality of workpieces to be arranged on the rotary table, the rotary table connects the conveyor to the preparation position and the cabinet at a predetermined rotational position, the shot processing apparatus has an inspection area for inspecting a state of the hole of the workpiece, between the preparation position and the rotation axis of the rotary table, the hole is formed at a bottom of the workpiece, the inspection area is set below the rotary table, and a first opening allowing the bottom of the workpiece to be viewed from below is formed in the rotary table.

2. The shot processing apparatus according to claim 1, wherein the conveyor includes a first conveyor and a second conveyor, the first conveyor and the second conveyor are arranged in such a way as to extend in a same direction as each other, and the first opening is provided between the first conveyor and the second conveyor.

3. The shot processing apparatus according to claim 2, wherein the conveyor includes a third conveyor and a fourth conveyor, the third conveyor and the fourth conveyor are arranged in such a way as to extend in a same direction as each other, and a second opening allowing the bottom of the workpiece to be viewed from below is formed in the rotary table between the third conveyor and the fourth conveyor.

4. The shot processing apparatus according to claim 3, wherein the cabinet, the rotation axis, and the preparation position are linearly arranged, the first conveyor, the second conveyor, the third conveyor, and the fourth conveyor extend in a same direction, and the first conveyor and the second conveyor, and the third conveyor and the fourth conveyor are arranged line-symmetrically with respect to a line in a radial direction crossing the rotation axis, the line serving as an axis of symmetry.

5. The shot processing apparatus according to claim 4, wherein the rotary table is supported at a predetermined height corresponding to the preparation position, and the shot processing apparatus further comprises a lifting and lowering unit lifting and lowering the workpiece to the preparation position.

6. The shot processing apparatus according to claim 4, wherein the shot processing apparatus applies a peening process to an inner wall of the hole.

7. The shot processing apparatus according to claim 3, wherein the rotary table is supported at a predetermined height corresponding to the preparation position, and the shot processing apparatus further comprises a lifting and lowering unit lifting and lowering the workpiece to the preparation position.

8. The shot processing apparatus according to claim 3, wherein the shot processing apparatus applies a peening process to an inner wall of the hole.

9. The shot processing apparatus according to claim 2, wherein the rotary table is supported at a predetermined height corresponding to the preparation position, and the shot processing apparatus further comprises a lifting and lowering unit lifting and lowering the workpiece to the preparation position.

10. The shot processing apparatus according to claim 9, wherein the shot processing apparatus applies a peening process to an inner wall of the hole.

11. The shot processing apparatus according to claim 2, wherein the shot processing apparatus applies a peening process to an inner wall of the hole.

12. The shot processing apparatus according to claim 1, wherein the rotary table is supported at a predetermined height corresponding to the preparation position, and the shot processing apparatus further comprises a lifting and lowering unit lifting and lowering the workpiece to the preparation position.

13. The shot processing apparatus according to claim 12, wherein the shot processing apparatus applies a peening process to an inner wall of the hole.

14. The shot processing apparatus according to claim 1, wherein the shot processing apparatus applies a peening process to an inner wall of the hole.

15. The shot processing apparatus according to claim 1, wherein the ejecting mechanism comprises:

a pressure tank configured to retain the shot media and connected to a compressed gas supply source;

a mixing unit connected to the compressed gas supply source and mixing the shot media supplied at a constant rate from the pressure tank with compressed air; and a nozzle connected to the mixing unit and ejecting the shot media together with the compressed air.

16. A shot processing method processing a workpiece with a hole formed therein, comprising:

a step of arranging a first workpiece at a preparation position;

a step of rotating a plate-like rotary table provided to be rotatable about a rotation axis and being provided, on an upper surface of the table, with a conveyor having a first end and a second end, thereby connecting the preparation position and the first end of the conveyor to each other;

a step of moving the first workpiece from the preparation position to the conveyor of the rotary table;

a step of rotating the rotary table with the first workpiece being arranged thereon, of connecting a cabinet including a processing chamber to the first end of the conveyor, and of connecting the preparation position to the second end of the conveyor;

a step of moving the first workpiece from the rotary table to the processing chamber;

a step of arranging a second workpiece at a preparation position;

a step of moving the second workpiece from the preparation position to the rotary table;

a step of moving the processed first workpiece to the rotary table;

a step of rotating the rotary table with the first workpiece and the second workpiece being arranged thereon, of connecting the cabinet to the second end of the conveyor, and of connecting the preparation position to the first end of the conveyor; and a step of moving the second workpiece from the rotary table to the processing chamber, and of inspecting the processed first workpiece on the rotary table.

* * * * *